US005727067A

United States Patent [19]

Iwamatsu

[11] Patent Number: 5,727,067

[45] Date of Patent: Mar. 10, 1998

[54] SOUND FIELD CONTROL DEVICE

[75] Inventor: Masayuki Iwamatsu, Hamamatsu, Japan

[73] Assignee: Yamaha Corporation, Japan

[21] Appl. No.: 694,548

[22] Filed: Aug. 9, 1996

[30] Foreign Application Priority Data

Aug. 28, 1995 [JP] Japan ..... 7-242578

[51] Int. Cl.[6] ..... H04R 5/00

[52] U.S. Cl. ..... 381/18; 381/1; 381/63

[58] Field of Search ..... 381/1, 17, 18, 381/63, 61

[56] References Cited

U.S. PATENT DOCUMENTS

| | | | |
|---|---|---|---|
| 4,856,046 | 8/1989 | Iwamatsu | 381/1 |
| 4,933,768 | 6/1990 | Ishikawa et al. | 381/18 |
| 4,980,914 | 12/1990 | Kunugi | 381/63 |
| 5,015,462 | 5/1991 | Lowe et al. | 381/17 |
| 5,261,005 | 11/1993 | Masayuki | 381/18 |
| 5,371,799 | 12/1994 | Lowe | 381/17 |
| 5,524,053 | 6/1996 | Iwamatsu | 381/18 |
| 5,657,391 | 8/1997 | Jyosako | 381/63 |

*Primary Examiner*—Curtis Kuntz
*Assistant Examiner*—Xu Mei
*Attorney, Agent, or Firm*—Graham & James LLP

[57] ABSTRACT

A sound field control device includes a surround decoder for decoding an input surround encode signal and generating three channel signals of L, C and R to be reproduced in front left, front center and front right and one channel signal of S to be reproduced in the rear, output terminals for outputting the three channel signals, a first reflected sound generation section generating a reflected sound of the signal S, a second reflected sound generation section generating another reflected sound signal of the signal S, a first adder adding the reflected sound signal generated by the first reflected sound generation section and the signal S together, a phase shifting section shifting phase of the reflected sound signal generated by the second reflected sound generation section according to frequency of the reflected sound signal, a second adder adding a reflected sound signal provided by the phase shifting section and the signal S together, and output terminals for outputting signals of RL and RR channels for reproduction in rear left and rear right positions or reverse positions. At least one of the first and second adders adds the reflected sound signal and the signal S together at a rate at which a value obtained by dividing level of the reflected sound signal by level of the signal S will become 0.5 or over.

3 Claims, 3 Drawing Sheets

SOUND FIELD CONTROL DEVICE

BACKGROUND OF THE INVENTION

This invention relates to a sound field control device for imparting a sound field effect in reproduction of music by an audio-visual device and, more particularly, to a sound field control device capable of producing an excellent sound field control effect with a simple circuit design.

The Dolby Prologic Surround (trademark) system is a popular system prevailing in the market as a surroundphonic sound system for imparting a sound field effect and there are many audio-visual devices incorporating a surround decoder for realizing this system. A Dolby Prologic decoder receives two-channel Dolby surround encode signals Lt and Rt, compares levels of Lt, Rt, Lt+Rt and Lt−Rt and detects, according to results of the comparison, which of the levels of the respective channels is higher, controls the levels of the respective channels according to the result of the detection and decodes the signals of the two channels to four channel signals of main signals L, C and R and a surround signal S through a matrix circuit. The signals L, C and R are reproduced by loudspeakers provided at front left, front center and front right positions of a listener and the signal S is reproduced by loudspeakers provided in the rear of the listener.

In the Dolby Prologic decoder, the single channel monaural signal S only is assigned for reproduction of sound in the rear of the listener. Therefore, even in a case where loudspeakers are provided in rear left and rear right positions of the listener and the surround signal S is supplied to these two loudspeakers for reproduction of a sound, a feeling of expansion of sound to the rear left and rear right of the listener cannot be obtained because signals reproduced from these loudspeakers are one and the same. There is a prior art device (e.g., U.S. Pat. No. 5,261,005 by the same inventor) according to which, for overcoming the above described disadvantage, a multiplicity of reflected sound signals of the surround signal S are produced and reproduced from respective loudspeakers. In this device, however, the feeling of expansion cannot be obtained unless a multiplicity of reflected sound signals are generated and processed and delay time of these reflected sound signals is provided and this requires a complicated circuit design resulting in a high production cost.

It is, therefore, an object of the invention to provide a sound field control device capable of producing an excellent sound field effect with a simple circuit design.

SUMMARY OF THE INVENTION

For achieving the above described object of the invention, there is provided a sound field control device comprising a surround decoder for decoding an input surround encode signal and thereby generating three channel signals of L, C and R which are assumed to be reproduced respectively in front left, front center and front right positions and one channel signal of S which is assumed to be reproduced in a rear position, output terminals for outputting the three channel signals of L, C and R for reproduction in the front left, front center and front right positions, first reflected sound generation means for generating a reflected sound of the signal S, second reflected sound generation means for generating another reflected sound signal of the signal S, first addition means for adding the reflected sound signal generated by the first reflected sound generation means and the signal S together, phase shifting means for shifting phase of the reflected sound signal generated by the second reflected sound generation means in accordance with frequency the reflected sound signal, second addition means for adding a reflected sound signal provided by the phase shifting means and the signal S together, and output terminals for outputting signals of RL and RR channels for reproduction of these signals in rear left and rear right positions or reverse positions, at least one of said first and second addition means adding the reflected sound signal and the signal S together at a rate at which a value obtained by dividing level of the reflected sound signal by level of the signal S will become 0.5 or over.

According to the invention, different reflected sound signals of the signal S are generated by the first and second reflected sound generation means, the original signal S is added to the generated reflected sound signals and the sum signals are reproduced in the rear left and rear right positions of the listener. The ratio of levels of the reflected sound signal and the signal S in adding them together are so set that a value obtained by dividing the level of the reflected sound signal by the level of the signal S will become 0.5 or over. This ratio setting is made for the following reason. It is known that, when a sound having a delay (i.e., reflected sound signal) is added to an original signal (i.e., signal S), cancellation and addition generally take place depending upon the frequency thereby producing a response characteristic called a comb filter. In the present invention, reflected sound signals generated by the reflected sound generation means are different reflected sound signals and, therefore, comb filters formed assume different characteristics. Correlation between the different reflected sound signals therefore is reduced. When the reflected sound signals of reduced correlation are respectively reproduced in the rear left and rear right positions of the listener, a feeling of expansion in hearing can be produced. When, particularly, the level of the reflected sound is set at a relatively large value so that a value obtained by dividing the level of the reflected sound by the level of the original signal S becomes 0.5 or over, the comb filter characteristic is enhanced with the result that a sufficient feeling of expansion in the rear left and rear right can be obtained even when a delay time of the reflected sound generation means is relatively short. The setting of the ratio of levels of the reflected sound signal to the signal S at 0.5 or over may be made in either of the left and right channels only but a greater feeling of expansion can be obtained by making this setting in both channels.

Further, in the present invention, a processing is applied to either of the left and right channel reflected sound signals by the phase shifting means so that its phase is shifted according to the frequency. This is for changing the phase between the left and right channels in a complex manner and thereby changing a feeling of expansion in the rear left and rear right provided by the two channels and thus improving the sound field effect to a more natural one. This is also effective for reducing correlation between the signals of the two channels and thereby enhancing the feeling of expansion in the rear left and rear right. In the phase shifting processing, phase only changes and a high frequency component does not change so that there does not occur a change in the tone color or increase in distortion. A phase shifting of a different characteristic may be applied to the other reflected sound signal of either the left and right channels.

In one aspect of the invention, the sound field control device further comprises addition means for, for generating a reflected sound which simulates a reflected sound produced when a reflected sound of the signal C is reflected from a hypothetic rear wall provided in the rear of a listener, delaying the signal C by a period of time necessary for realizing a delay time of the reflected sound from the hypothetic rear wall, correcting frequency characteristic of the signal C by imparting it with a band cutting characteristic for simulating a characteristic of the reflected sound to make a circuit round listener's ears, and adding the thus processed signal C to the signal S applied to the first and second reflected sound generation means at a desired ratio of level.

According to this aspect of the invention, a reflected sound which is produced when the reflected sound of the signal C is reflected on the hypothetic rear wall in the rear of the listener is simulated to give the listener an image of space such as one which he can feel when he watches a movie in a movie theater. For realizing this, the signal C is delayed by a period of time necessary for realizing a delay time of the reflected sound of the signal C from the hypothetic rear wall, correction of the frequency characteristic is made by imparting a band cutting characteristic for simulating a characteristic to make circuit round the listener's ears and the thus processed reflected sound signal is added to the signal S and the sum signal is applied to the first and second reflected sound generation means.

In another aspect of the invention, the input surround encode signal is two channel signals of Lt and Rt and the sound field control device further comprises input difference signal addition means for adding a difference signal Lt–Rt between the input signals Lt and Rt to the signal S applied to the first and second reflected sound generation means at a desired ratio of level.

According to this aspect of the invention, the phenomenon that a non-dominant signal is deteriorated by a dominant signal in a dominance emphasizing operation in the Dolby Prologic surround decoding is overcome. The surround decoder in the Dolby Prologic system realizes a channel separation of a high degree on the basis of the dominance emphasizing operation in decoding the two channel signals Lt and Rt to the four channel signals L, C, R and S. According to the dominance emphasizing operation, in a state wherein a channel of a high level (dominant channel) is considered to exist among the channels L, C, R and S, a coefficient of a matrix decoder section for converting the two channels to the four channels is controlled to cancel channels of a lower level (non-dominant channels) and emphasize the dominant channel. Assume, for example, that a human talk exists at a high level in the channel C and a stereophonic music exists at a low level in the channels L and R. In this case, the Dolby Prologic surround decoder outputs the human talk in the channel C but the music which should have existed as a stereophonic music in the channels L and R is led to the channel C in the form of a monaural music. According to this aspect of the invention, a suitable amount of difference signal between the signals Lt and Rt is added to the signal S and a feeling of expansion in the non-dominant channels is compensated by simulating a stereophonic sound by the expansion effect of the invention. Simultaneously, this effect of compensating for the feeling of expansion of stereophonic sounds is effective also in enhancing the feeling of expansion in a case where the interval between left and right loudspeakers is small as in a television.

The sound field control device according to the invention can be incorporated in an audio-visual amplifier or a receiver and can also be incorporated in a television receiver in the form of a surround LSI for a television.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

Figure 1:
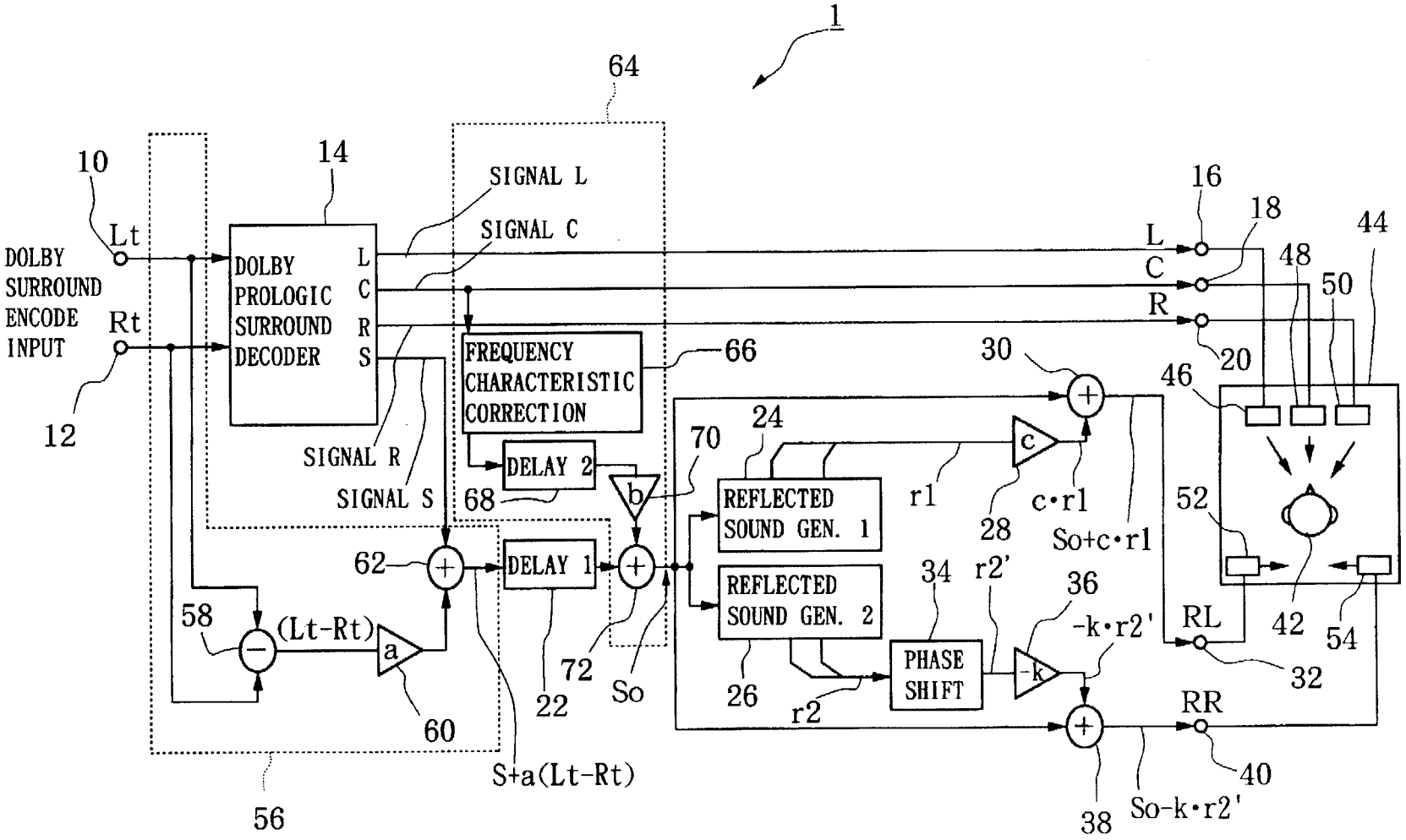
FIG. 1 is a block diagram showing an embodiment of the invention.

FIG. 1 shows an embodiment of the invention. To input terminals 10 and 12 are applied Dolby surround encoded two channel signals Lt and Rt and these input signals Lt and Rt are transmitted to a Dolby Prologic surround decoder 14. The Dolby Prologic surround decoder 14 detects dominance in the level with respect to the input signals Lt and Rt among Lt, Rt, Lt+Rt and Lt–Rt and, in accordance with result of detection of dominance, judges dominance among the respective channels. The decoder 14 controls the level of the respective channels in accordance with result of judgement of dominance and decodes the two channel signals to four channel signals of main signals L, C and R and a surround signal S through a matrix circuit. Among the decoded outputs, the signals L, C and R are delivered out of main signal output terminals 16, 18 and 20.

Figure 2:
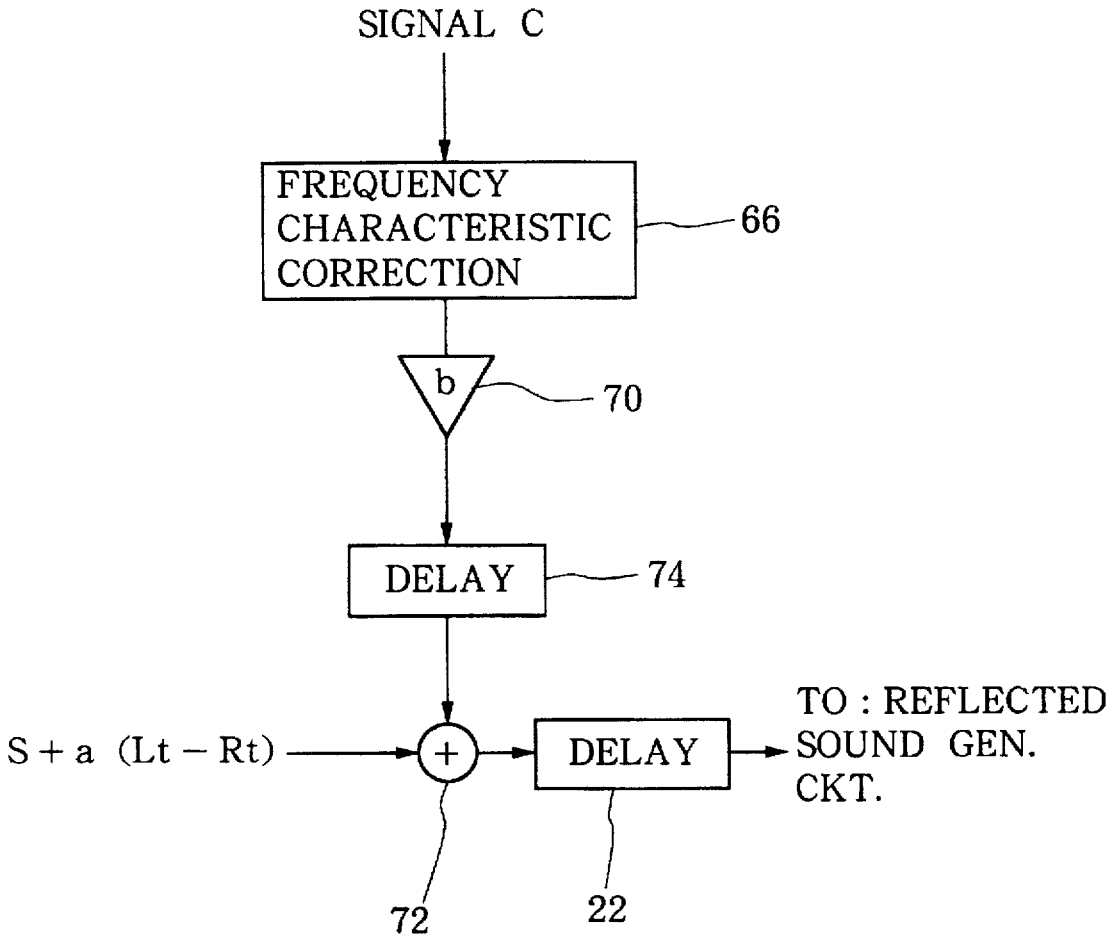
FIG. 2 is a block diagram showing a structure in which a single delay circuit is used as delay circuits 68 and 22 of FIG. 1.

The signal S is applied to an input difference signal addition circuit 56. The input difference signal addition circuit 56 is provided for compensating for deterioration of a non-dominant signal by a dominant signal by the dominance emphasizing operation in the Dolby Prologic surround decoding. In the input difference signal addition circuit 56, a difference Lt–Rt between the input signals Lt and Rt is computed by a subtractor 58. The difference signal L–R is provided with a gain a by a coefficient generator 60 and then is added to the signal S by an adder 62. An output signal S+a(Lt–Rt) of the adder 62 is delayed by a predetermined length of time (e.g., 15 msec to 30 msec) by a delay circuit 22 provided for imparting an initial delay and then is applied to a signal C addition circuit 64. The signal C addition circuit 64 produces a reflected sound of the signal C from a hypothetic rear wall by simulation. The signal C addition circuit 64 applies, for emphasizing the impression of a sound coming from the rear, the signal C with a frequency characteristic correction for simulating a characteristic to make a circuit round the listener's ears with a frequency characteristic correction circuit 66. As a result of a hearing test, the most effective frequency characteristic correction was a band-cutting characteristic of f=5.87 kHz, Q=1.85, G=–4.9 dB and an error in the order of ±2 dB. The signal C which has been corrected in the frequency characteristic is delayed by a delay circuit 68 by a time length corresponding to a delay time (initial delay) of the reflected sound from the hypothetic rear wall. The signal C is then imparted with a coefficient b by a coefficient generator 70 and added to the signal S+a(Lt–Rt) by an adder 72. Instead of providing the separate delay circuits 22 and 68, a single delay circuit 22 may serve concurrently as the delay circuits 22 and 68 as shown in FIG. 2. In FIG. 2, a delay circuit 74 corresponds to a difference between the delay circuits 22 and 68. Since this delay time is short, this circuit design can be made in a smaller size than the circuit design in which the two delay circuits 22 and 68 are separately provided.

An output signal So of the adder 72 is applied to reflected sound generation circuits 24 and 26. The reflected sound generation circuits 24 and 26 have different reflected sound parameters which are prepared by combination of delay time data and gain data and performs a convolution operation with respect to the input signal So and the respective reflected sound parameters to produce a plurality of reflected sounds. The respective reflected sound parameters of the reflected sound generation circuits 24 and 26 are not required to correlate but can be set independently from each other. Any desired number of reflected sounds can be chosen so that the number of reflected sounds can be reduced from the number which has been required in the past. In the example of FIG. 1, for example, the circuits 24 and 26 each produce two reflected sounds. In the case of a system in which the feeling of expansion is obtained by producing reflected sounds on the basis of a hypothetic sound source distribution, it is necessary to produce reflected sounds up to about 300 msec. In contrast, in the device of FIG. 1 which intends to realize the feeling of expansion of a sound field by intentionally creating a comb filter characteristic with an original signal and its delayed sound (reflected sound) and utilizing the delayed signal as a signal of a low correlation to the original signal, a sufficient effect can be obtained with a reflected sound up to the order of about 30 msec and, therefore, the circuit design can be made compact.

A reflected sound signal r1 produced by the reflected sound generation circuit 24 is imparted with a gain c by a coefficient generator 28, if necessary, to produce a reflected sound signal c·r1 which in turn is added to the original signal So and a signal So+c·r1 is provided as a left channel surround signal RL from a surround signal output terminal 32. The coefficient generator 28. The coefficient generator 28 is provided for adjusting the amplitude level of the reflected sound signal r1 generated by the reflected sound generation circuit 24 so that the amplitude level of each reflected sound signal c·r1 will finally become a predetermined level within the range between 0.5 and 1.0 of the amplitude level of the original signal So. By this arrangement, an absolute level ratio |(c·r1)/(So)| is set at a value which is 0.5 or larger if gain data for each reflected sound parameter in the reflected sound generation circuit 24 is preset at a value which includes an adjusting gain corresponding to the above gain c, or if the amplitude level of the output r1 from the reflected sound generation circuit 24 satisfies the above conditions, the gain adjustment by the coefficient generator 28 will be unnecessary.

Figure 3:
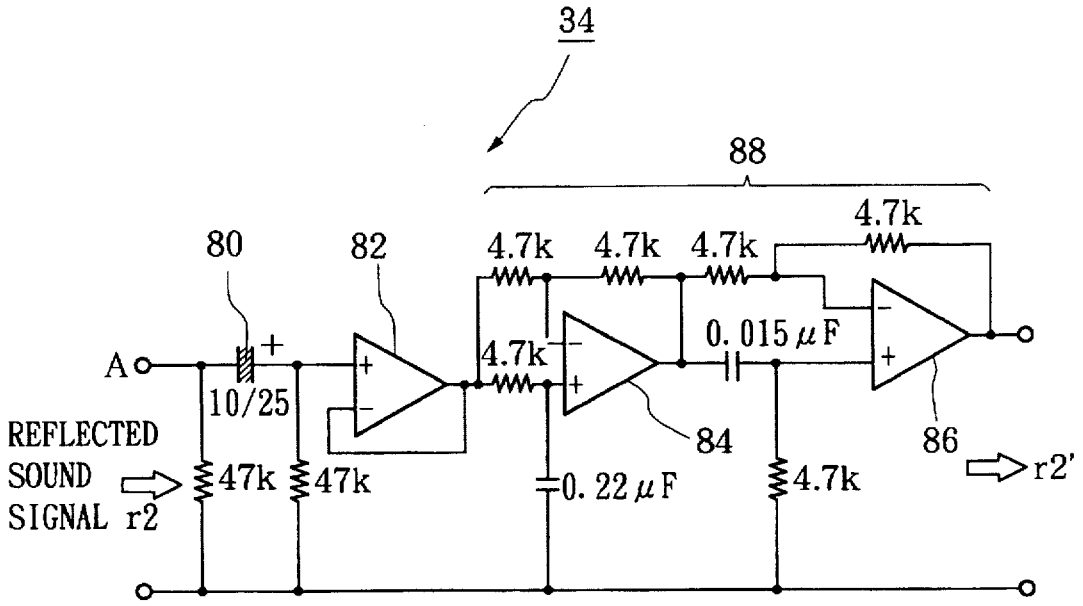
FIG. 3 is a block diagram showing a specific example of a phase shifting circuit 84 in FIG. 1.
Figure 4:
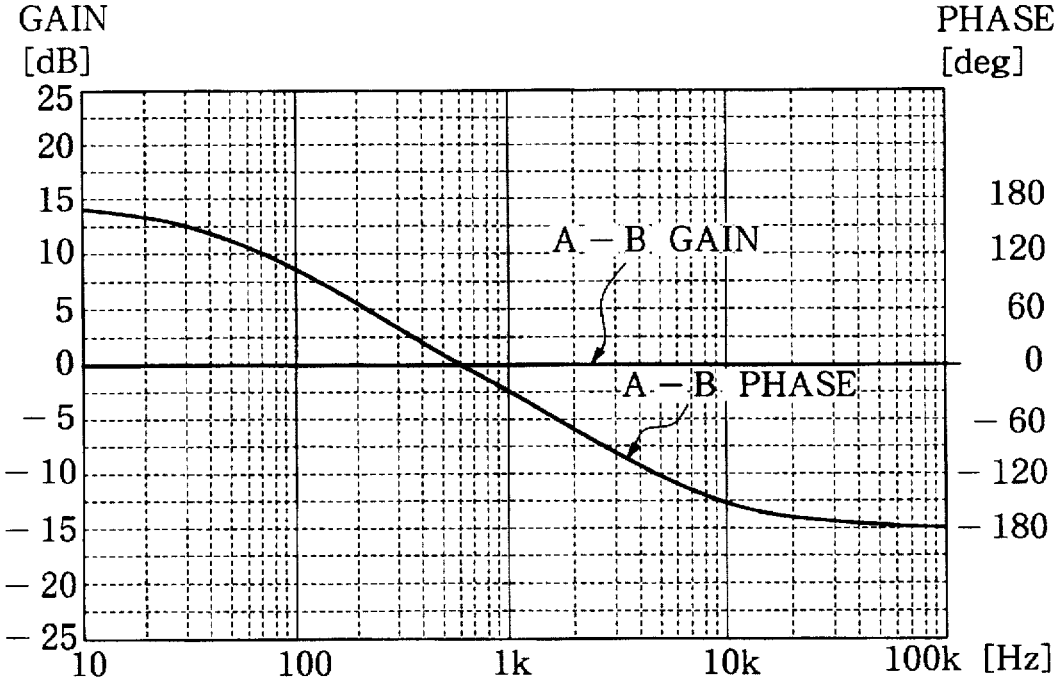
FIG. 4 is a graph showing relation of gain and phase to frequency in the phase shifting circuit 34 of FIG. 3.

A reflected sound signal r2 generated by the reflected sound generation circuit 26 is subjected to a phase shifting processing in which the phase of the signal r2 is changed according to the frequency by a phase shifting circuit 34. An example of the phase shifting circuit 34 is shown in FIG. 3. A de component in the input reflected sound signal r2 is removed by a capacitor 80. The reflected sound signal r2 then is supplied through a buffer amplifier 82 to a phase shifter 88 composed of inverting amplifiers 84 and 86 in which the reflected sound signal is subjected to a phase shifting processing in which its phase is changed according to the frequency. Relation of gain and phase to frequency of the phase shifting circuit 34 of FIG. 3 is shown in FIG. 4. According to FIG. 4, the gain is flat in A - B and the phase changes according to the frequency in A - B. Another phase shifting circuit having a characteristic which is different from that of the phase shifting circuit 34 may be additionally provided on the output side of the reflected sound generation circuit 24.

The reflected sound signal r2' provided from the phase shifting circuit 34 is imparted with a gain k and inverted in phase by a coefficient generator 36 to produce a signal −k r2'. The phase of the signal is inverted for unlocalization of the signal by making it opposite in phase to the reflected signal r1. Without inversion (i.e., by generating a signal k·r2'), the advantageous result of the invention can be obtained. The gain k imparted by the coefficient generator 36 may be adjusted, like the above described gain c, by using the gain parameter of the reflected sound generation circuit 26. Instead of setting the absolute ratio of the reflected sound signal r1 to the signal S|(c·r1)/(So)| at a value of 0.5 or larger, or in addition to this setting of the absolute ratio, the absolute ratio of levels of the reflected sound signal r2' to the original signal S, i.e., |(k·r2')/(So)| may be set at a value of 0.5 or larger. The reflected sound signal −k·r2' ia added to the original signal So by an adder 38 and a sum signal So −k·r2' is provided as a right channel surround signal RR from a surround output terminal 40.

In a chamber 44 in which a listener 42 is, main loudspeakers 46, 48 and 50 are provided in front left, front center and front right positions of the listener 42. Surround loudspeakers 52 and 54 are provided in rear left and rear right positions of the listener 42.

According to the sound field control device 1 of the above described construction, the input two channel surround encode signals Lt and Rt are decoded by the surround decoder 14 to the four channel signals L, C, R and S and the signals L, C and R among them are reproduced by front loudspeakers 46, 48 and S0 with a clear localization. As to the signal S, the different reflected sound signals r1 and r2 are produced by the reflected sound generation circuits 24 and 26 and reproduced by loudspeakers 52 and 54 located in the rear left and rear right of the listener 42. In this case, since the coefficient c (k) of the coefficient generator 28 (36) is so set that, at least in either of the adders 30 and 38, a value obtained by dividing the level of the reflected sound signal r1 (r2) by the level of the original signal S will become 0.5 or over, the comb filter characteristic is emphasized with the result that similarity between the left and right waveforms is reduced whereby a sufficient feeling of expansion in the rear left and rear right can be achieved. Besides, since the reflected sound signal r2 is subjected to a phase shifting processing by the phase shifting circuit 34 so that its phase will change according to the frequency so that the feeling of expansion in the rear left and rear right changes with the result that the sound field effect has a more natural impression and similarity between the left and right wafeforms is further reduced whereby the feeling of expansion in the rear left and rear right is enhanced.

Further, depending upon the type of the signal, the following desirable difference will be produced. In a case where the signal S is a regularly occurring short sound (such as a sound of a rhythm musical instrument), this is not a continuous sound and, therefore, there is little or no overlapping of a direct sound and a delayed sound. Accordingly, its base sound portion is localized relatively clearly. In a case where the signal S is a continuous sound such as a sound of a violin, a direct sound and a delayed sound are both heard in an overlapped state. In this case, similarity in the left and right waveforms is small according to the device of the present invention so that an excellent feeling of extension can be achieved even if the delay time of the reflected sound generation circuits 24 and 26 is short. In a case where, as in the case of a sound from a synthesizer of an electronic musical instrument, the signal S is a continuous sound in which a timewise modulation is applied to its note interval or strength for imparting variation to the sound, a further complex change takes place. More specifically, when a note interval changes with time, the output of the phase shifting circuit 34 changes in its waveform according to the frequency and similarity between an input waveform and an output waveform changes with time. The phase shifting circuit 34 reduces correlation between the left and right waveforms whereby a feeling of unlocalization of the sound extends widely to the left and right. In this case, the function of the phase shifting circuit 34 changes the phase only and, therefore, change in the tone color or increase in distortion will not take place. Thus, the sound field effect differs depending upon the nature of a musical instrument played, a rear sound field which is rich in variety, e.g., a sound field in which a sound of a synthesizer expands widely in the background while a sound of a rhythm musical instrument is heard distinctly, can be realized. In this case, the reflected sound generation circuits 24 and 26 can achieve a sufficient sound field effect with a delay time which is one tenths of the prior art system reproducing a hypothetic sound source distribution so that the circuit design can be made significantly compact as compared with the prior art system.

Further, according to the sound field control device 1 of FIG. 1, a reflected sound from a hypothetic rear wall of the signal C is produced by the signal C addition circuit 64 and is added to the signal S. This imparts an impression of space as if one was watching a movie in a movie theater. Moreover, the input difference signal Lt–Rt is produced in the input difference signal addition circuit 56 and this signal is added to the signal S. This prevents deterioration of a nondominant signal by the dominance emphasizing operation and enhances a feeling of expansion provided by the nondominant signal. Furthermore, the feeling of expansion is compensated also in a case where the interval between left and right loudspeakers is small as in a television.

What is claimed is:

1. A sound field control device comprising:

a surround decoder for decoding an input surround encode signal and thereby generating three channel signals of L, C and R which are assumed to be reproduced respectively in front left, front center and front right positions and one channel signal of S which is assumed to be reproduced in a rear position;

output terminals for outputting the three channel signals of L, C and R for reproduction in the front left, front center and front right positions;

first reflected sound generation means for generating a reflected sound of the signal S;

second reflected sound generation means for generating another reflected sound signal of the signal S;

first addition means for adding the reflected sound signal generated by the first reflected sound generation means and the signal S together;

phase shifting means for shifting phase of the reflected sound signal generated by the second reflected sound generation means in accordance with frequency of the reflected sound signal;

second addition means for adding a reflected sound signal provided by the phase shifting means and the signal S together; and output terminals for outputting signals of RL and RR channels for reproduction of these signals in rear left and rear right positions or reverse positions, at least one of said first and second addition means adding the reflected sound signal and the signal S together at a rate at which a value obtained by dividing level of the reflected sound signal by level of the signal S will become 0.5 or over.

2. A sound field control device as defined in claim 1 which further comprises addition means for generating a reflected sound which simulates a reflected sound produced when a reflected sound of the signal C is reflected from a hypothetic rear wall provided in the rear of a listener, delaying the signal C by a period of time necessary for realizing a delay time of the reflected sound from the hypothetic rear wall, correcting frequency characteristic of the signal C by imparting it with a band cutting characteristic for simulating a characteristic of the reflected sound to make a circuit round listener's ears, and adding the thus processed signal C to the signal S applied to the first and second reflected sound generation means at a desired ratio of level.

3. A sound field control device as defined in claim 1 wherein the input surround encode signal is two channel signals of Lt and Rt and which further comprises input difference signal addition means for adding a difference signal Lt–Rt between the input signals Lt and Rt to the signal S applied to the first and second reflected sound generation means at a desired ratio of level.

* * * * *